US005372099A

United States Patent [19]

Matsunuma et al.

[11] Patent Number: 5,372,099

[45] Date of Patent: Dec. 13, 1994

[54] CERAMIC ADJUSTING SHIM

[75] Inventors: Kenji Matsunuma; Takao Nishioka; Akira Yamakawa, all of Itami, Japan

[73] Assignee: Sumitomo Electric Industries, Ltd., Japan

[21] Appl. No.: 174,471

[22] Filed: Dec. 28, 1993

Related U.S. Application Data

[63] Continuation-in-part of Ser. No. 901,998, Jun. 22, 1992, abandoned.

[30] Foreign Application Priority Data

Jul. 19, 1991 [JP] Japan ..... 3-179511

[51] Int. Cl.[5] ..... F01L 1/16

[52] U.S. Cl. ..... 123/90.48; 123/90.51; 123/90.52; 74/569

[58] Field of Search ..... 123/90.48, 90.51, 90.52; 74/569

[56] References Cited

U.S. PATENT DOCUMENTS

| | | | |
|---|---|---|---|
| 4,366,785 | 1/1983 | Goloff et al. | 123/90.51 |
| 4,508,067 | 4/1985 | Fuhrmann | 123/90.51 |
| 4,909,198 | 3/1990 | Shiraya et al. | 123/90.51 |
| 5,060,607 | 10/1991 | Taniguchi | 123/90.51 |

FOREIGN PATENT DOCUMENTS

| | | | |
|---|---|---|---|
| 3239325 | 4/1984 | Germany | 123/90.51 |
| 165508 | 9/1983 | Japan | 123/90.51 |
| 2093554 | 9/1982 | United Kingdom | 123/90.51 |
| 2127928 | 4/1984 | United Kingdom | 123/90.51 |

*Primary Examiner*—E. Rollins Cross
*Assistant Examiner*—Weilun Lo
*Attorney, Agent, or Firm*—Jordan B. Bierman

[57] ABSTRACT

The preset invention provides a ceramic adjusting shim capable of minimizing the abrasion of parts contacting the adjusting shim, for example, a cam and a tappet. The ceramic adjusting shim is produced from a ceramic material and has a surface roughness of 0.05 to 0.2 μm in ten-point average roughness Rz.

4 Claims, 2 Drawing Sheets

CERAMIC ADJUSTING SHIM

This application is a continuation-in-part of U.S. patent application Ser. No. 901,998 filed Jun. 22, 1992, now abandoned.

BACKGROUND OF THE INVENTION

1. Field of the Invention

This invention relates to an adjusting shim used in a valve operating mechanism for an internal combustion engine.

b 2. Description of the Prior Art

FIG. 3 is a longitudinal section of a valve operating mechanism for an engine. Referring to FIG. 3, a reference numeral 1 denotes a cylinder head of an engine, 2 a cam, 3 a valve lifter, 4 an adjusting shim, 5 an in take and exhaust valve, 6 a valve seat and 7 a valve spring. In the valve operating mechanism shown in FIG. 3, the valve lifter 3 is driven by the cam 2, and the displacement of the cam 2 is transmitted to the intake and exhaust valve 5. As may be understood from FIG. 3, an adjusting shim 4 is disposed between the valve lifter 3 and cam 2. A longitudinal section of the adjusting shim 4 is shown in FIG. 1. The adjusting shim 4 is used to regulate a valve clearance. Although a conventional adjusting shim 4 consists usually of a metal, there is an adjusting shim formed out of a ceramic material for the purpose of reducing the weight thereof and improving the wear resistance thereof.

However, even when the weight of a ceramic adjusting shim is reduced, a decrease in a power loss caused thereby is not substantially recognized in practice since the percentage of the inertial weight of the adjusting shim with respect to the whole inertial weight of the valve operating system is extremely small. Moreover, the offensiveness of the shim with respect to the parts with which the shim contacts, i.e., the cam 2 and valve lifter 3 shown in FIG. 3 increases, so that these two parts wear greatly.

SUMMARY OF THE INVENTION

Therefore, an object of the present invention is to provide a ceramic adjusting shim having a smooth surface in which the above-mentioned problems are eliminated.

According to the present invention, there is provided a ceramic adjusting shim comprising a ceramic material the surface roughness of which is not more than 2.0 μm in ten-point average roughness (Rz).

As the ceramic material for the ceramic adjusting shim, silicon nitride is mainly used. The surface roughness of the adjusting shim is preferably not more than 0.8 μm and more preferably not more than 0.2 μm, in ten-point average roughness (Rz).

DETAILED DESCRIPTION OF THE PREFERRED EMBODIMENTS

The present invention will be now described in detail hereinbelow.

Figure 3:
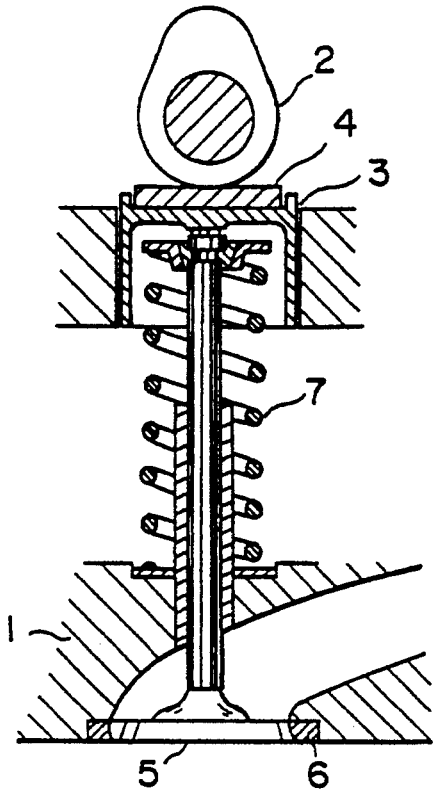
FIG. 3 is a longitudinal section of a valve operating mechanism for an engine.

When a ceramic adjusting shim having a smooth surface is used, a frictional loss occurring between the cam and the ceramic adjusting shim can be reduced, so that a power loss of the internal combustion engine can be minimized. Moreover, the offensiveness of the ceramic adjusting shim with respect to the cam 2 and valve lifter 3 shown in FIG. 3 decreases, and the abrasion of these two parts can therefore be reduced.

In this case, the roughness of the surface (designated by a reference numeral 8 in FIG. 1), which the cam contacts of the ceramic adjusting shim is not more than 2.0 μm in ten-point average roughness (Rz), and a torque loss caused thereby becomes smaller than that in a case where a conventional metal adjusting shim is used. When the ten-point average roughness (Rz) is up to 0.2 μm, a torque loss decreases in accordance with a decrease in the surface roughness. In a region in which the ten-point average roughness (Rz) of the contact surface is less than 0.2 μm, a torque loss caused thereby is substantially equal to that in a case where the ten-point average roughness is 0.2 μm.

In a region in which the roughness of the surfaces (designated by reference numerals 9 and 10 in FIG. 1), which the valve lifter contacts, of the ceramic adjusting shim is not more than 0.8 μm in ten-point average roughness, an abrasion loss of the valve lifter decreases sharply in accordance with a decrease in the surface roughness of the ceramic adjusting shim, and, in a region in which the surface roughness of the same shim is less than 0.2 μm, and abrasion loss of the valve lifter becomes substantially constant.

On the other hand, forming a shim having a surface roughness of less than 0.05 μm is known to be extremely expensive and time consuming due to the inefficient grinding process necessary to obtain such a small surface roughness. The discovery that, with ceramic adjusting shims, approximately the same results will be achieved with a shim having a surface roughness of 0.2 μm and one which has a surface roughness of 0.05 μm, obviates the necessity of taking the additional manufacturing steps to form a shim having extremely smooth surfaces. Further, it has been found that, surprisingly, when shims having an extremely small surface roughness are used, and actual increase in power consumption (an increase in power loss) is observed.

The present invention will now be described concretely on the basis of its embodiments.

EXAMPLE 1

Figure 1:
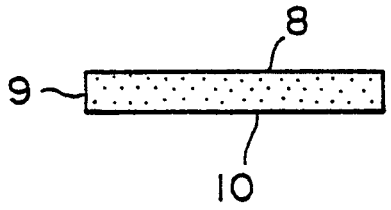
FIG. 1 is a longitudinal section of an adjusting shim.
Figure 4:
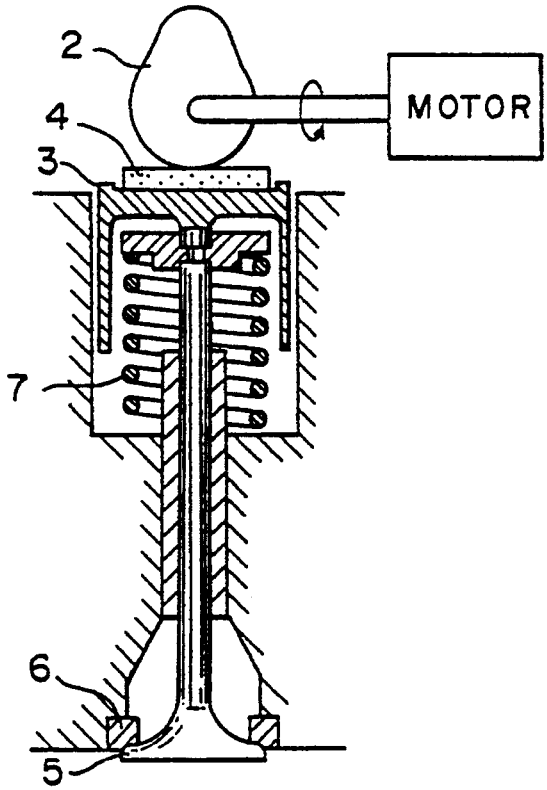
FIG. 4 is a longitudinal section of an apparatus for testing a product according to the present invention.

The same adjusting shims as shown in FIG. 1 were produced out of a silicon nitride ceramic sintered body having a relative density of not less than 98%. The surface, which a cam contacts. i.e. the surface designated by a reference numeral 8 shown in FIG. 1, of each of the adjusting shims was finished under various conditions by a diamond wheel to set the roughness of the surfaces of these adjusting shims thus produced was subjected to the evaluation of power loss with respect to the power consumption of a motor rotated at a predetermined number of revolutions per minute (2000 RPM and 4000 RPM in terms of number of revolutions per minute of engine), by using a motoring system shown in FIG. 4 and simulating an over head camshaft type valve operating mechanism. Table 1 shows the results of the above with the results of similar evaluation of power loss caused by conventional steel adjusting shims which constitute comparative examples.

TABLE 1

| No. | Material for adjusting shim | Surface roughness Rz of contact surface (μm) | Power consumption of motor (kW) 2000 RPM | 4000 RPM |
|---|---|---|---|---|
| 1 | Silicon nitride | 1.5 | 1.13 | 1.24 |
| 2 | Silicon nitride | 1.2 | 1.11 | 1.22 |
| 3 | Silicon nitride | 1.0 | 1.08 | 1.18 |
| 4 | Silicon nitride | 0.7 | 1.00 | 1.10 |
| 5 | Silicon nitride | 0.5 | 0.94 | 1.03 |
| 6 | Silicon nitride | 0.2 | 0.90 | 0.99 |
| 7 | Silicon nitride | 0.05 | 0.89 | 0.98 |
| *8 | Silicon nitride | 2.5 | 1.20 | 1.32 |
| *9 | Silicon nitride | 5.0 (not processed) | 1.32 | 1.45 |
| *10 | Cr—Mo steel | 5.0 | 1.17 | 1.28 |

*comparative example

EXAMPLE 2

The adjusting shims produced out of various kinds of ceramic materials were subjected to the evaluation of power loss caused thereby by a method identical with that used in Example 1, and the results are shown in Table 2.

TABLE 2

| No. | Material for adjusting shim | Surface roughness Rz of contact surface (μm) | Power consumption of motor (kW) 2000 RPM | 4000 RPM |
|---|---|---|---|---|
| 11 | Zirconia | 0.05 | 0.91 | 1.00 |
| 12 | Zirconia | 1.0 | 1.11 | 1.22 |
| 13 | Composite material of SiC—$Si_3N_4$ | 1.0 | 1.09 | 1.19 |
| 14 | Composite material of SiC—$Si_3N_4$ | 0.2 | 0.92 | 1.01 |
| *15 | Zirconia | 5.0 | 1.34 | 1.47 |
| *16 | Composite material of SiC—$Si_3N_4$ | 8.0 (not processed) | 1.36 | 1.49 |
| *10 | Cr—Mo steel | 5.0 | 1.17 | 1.28 |

*comparative examples

EXAMPLE 3

Figure 2:
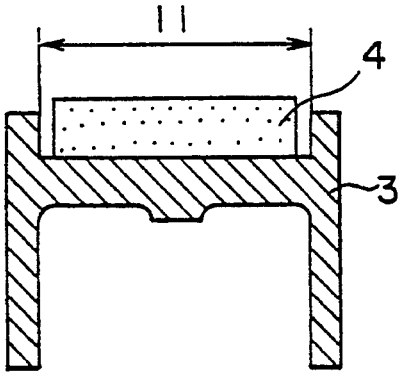
FIG. 2 is a longitudinal section of an adjusting shim and a valve lifter.

Each of the adjusting shims produced under the same conditions as in Example 1 was subjected to a 200-hour continuous operation test with a motor rotated at a predetermined number of revolutions per minute (6000 RPM in terms of number of revolutions per minute of engine), by using the motoring system used in Example 1, and the abrasion loss, which was determined after the tests had been completed, of the valve lifter was evaluated. The evaluating of the abrasion loss of the valve lifter was done by measuring the inner diameter, which is shown by a reference numeral 11 in FIG. 2, of the valve lifter before and after each test was conducted, and determining the quantity of variation thereof. The results of the evaluation are shown in Table 3.

TABLE 3

| No. | Material for adjusting shim | Surface Roughness Rz of contact surface (μm) | Abrasion loss** (μm) |
|---|---|---|---|
| 17 | Silicon nitride | 1.5 | 12 |
| 18 | Silicon nitride | 1.2 | 11 |
| 19 | Silicon nitride | 1.0 | 10 |
| 20 | Silicon nitride | 0.7 | 5 |
| 21 | Silicon nitride | 0.5 | 3 |
| 22 | Silicon nitride | 0.2 | 1 |
| 23 | Silicon nitride | 0.05 | <1 |
| *24 | Silicon nitride | 2.5 | 18 |
| *25 | Silicon nitride | 5.0 (not processed) | 20 |

*comparative example
**Abrasion loss: Difference between the inner diameter of valve lifter measured before test was conducted and that thereof measured after test was conducted.

The present invention is not limited to these embodiments. The surfaces of the adjusting shims were smoothed by being processed with a diamond wheel. Even if these surfaces are smoothed by being subjected to chemical and physical surface treatments (etching and coating), or a chemical applying treatment which is conducted before and after the sintering of a ceramic material, obtaining the same:effect as those in the embodiments can be expected. The same effect can also be expected even if the roughness of the surfaces designated by the reference numerals 8, 9 and 10 in FIG. 1 is set to different levels according to different purposes.

The adjusting shim according to the present invention enables a power loss and wear resistance of a valve operating system to be reduced and increased respectively, and the fuel consumption, performance and durability of an internal combustion engine to be improved.

TABLE 4

| No. | Surface roughness Rz of contact surface (μm) | Power consumption of motor (kW) 2000 RPM | 4000 RPM | Ratio of processing cost (%) | Surface treatment process and class of abrasive grain size: Grinding | Lapping + Polishing |
|---|---|---|---|---|---|---|
| 26 | 0.05 | 0.89 | 0.98 | 100 | #200 + #800 + #1200 | not done |
| 27* | 0.03 | 1.02 | 1.14 | 900 | #200 + #800 + #1200 | #2000 + #4000 |
| 28* | 0.01 | 1.08 | 1.19 | 1800 | #200 + #800 + #1200 | #2000 + #4000 + #8000 + #10000 |

Note: *Comparative Samples

What is claimed is:

1. A ceramic adjusting shim comprising a ceramic material, said adjusting shim being movably disposed on a valve lifter with a clearance between a lateral surface of said adjusting shim and said valve lifter, an upper surface of said adjusting shim which contacts a cam having a surface roughness of 0.05 μm to 0.2 μm in 10-point average roughness (Rz), said lateral surface and said base surface, which contact said valve lifter, having a surface roughness of 0.05 to 0.2 μm in 10-point average roughness (Rz).

2. The adjusting shim of claim 1 wherein the surface roughness of said upper surface is identical to the surface roughness of said lateral and base surface.

3. The adjusting shim of claim 1 wherein the surface roughness of said upper surface is different from the surface roughness of said lateral and base surfaces.

4. A ceramic adjusting shim according to claim 1, wherein said ceramic material consists mainly of silicon nitride.

* * * * *